US008601728B2

(12) United States Patent
Philipps

(10) Patent No.: US 8,601,728 B2
(45) Date of Patent: Dec. 10, 2013

(54) PACKAGING SYSTEM AND CARTON

(76) Inventor: Igor John Philipps, Brampton (CA)

( * ) Notice: Subject to any disclaimer, the term of this patent is extended or adjusted under 35 U.S.C. 154(b) by 60 days.

(21) Appl. No.: 12/986,588

(22) Filed: Jan. 7, 2011

(65) Prior Publication Data

US 2011/0168769 A1 Jul. 14, 2011

Related U.S. Application Data

(60) Provisional application No. 61/282,252, filed on Jan. 8, 2010.

(51) Int. Cl.
*G09F 3/00* (2006.01)

(52) U.S. Cl.
USPC ..... 40/312; 206/776; 229/125.21

(58) Field of Classification Search
USPC ..... 40/312, 124.03; 206/776, 777, 769, 206/778; 229/125.08, 125.21, 162.1, 229/125.01, 125.19, 71, 80, 247, 125.37
See application file for complete search history.

(56) References Cited

U.S. PATENT DOCUMENTS 2,289,236 A * 7/1942 Broderick ..... 229/107
6,223,400 B1 * 5/2001 Lenack ..... 24/306
6,305,547 B1 * 10/2001 Curran ..... 206/542
6,662,945 B1 * 12/2003 Chang ..... 206/372
2005/0087469 A1 * 4/2005 Carty et al. ..... 206/461
2009/0294311 A1 * 12/2009 Caldwell ..... 206/281
2010/0051678 A1 * 3/2010 Anderson et al. ..... 229/162.1

* cited by examiner

*Primary Examiner* — Joanne Silbermann
(74) *Attorney, Agent, or Firm* — Harness, Dickey & Pierce, P.L.C.

(57) ABSTRACT

A packaging system is provided which includes a carton having sides defining an enclosure for receiving contents. At least one of the sides is hingedly connected to the carton for opening and closing of the carton. At least one side has a flap for extending over an adjacent side when the carton is in the closed configuration. Releasable fastening means are provided which have a first part of a releasable fastener secured to the flap to register with and engage a second part of the releasable fastener which is secured to the adjacent side. The first and second parts of the releasable fastener require a force for separation which is below a force required to tear the flap or the adjacent side. The packaging system may further include a securing means for securing the contents from unfolding while permitting tactile content with the contents to facilitate opening of the carton, removal and touching of the contents without unfolding the contents, replacement of the contents in the carton and closing of the carton without damage to the carton.

5 Claims, 9 Drawing Sheets

PACKAGING SYSTEM AND CARTON

CROSS REFERENCE TO RELATED APPLICATIONS

This application claims the benefit and priority of U.S. Patent Application No. 61/282,252 filed Jan. 8, 2010. The entire disclosure of the above application is incorporated herein by reference.

BACKGROUND OF THE INVENTION

1. Field of the Invention

This invention relates to packaging. More particularly this invention relates to cartons.

2. Discussion

Consumers do not like torn packaging and tend to reject product in a torn or damaged carton because of a concern that the damage to the package may be indicative of damage to the contents thereof or that parts may be missing from a complete set as offered on the carton or package.

Although consumers do not like open or torn cartons, perhaps somewhat incongruously consumers like to open cartons to inspect the contents before purchase. Often this damages the carton. Human nature being what it is consumers are known to open and inspect a carton causing damage to that carton and then completing their purchase with a new previously unopened carton.

It is an object of the present invention to provide a carton and a packaging system which addresses at least some of the above problems.

SUMMARY OF THE INVENTION

A packaging system is provided which includes a carton having sides defining an enclosure for receiving contents. At least one of the sides is hingedly connected to the carton for opening and closing of the carton. At least one side has a flap for extending over an adjacent side when the carton is in the closed configuration. Releasable fastening means are provided which have a first part of a releasable fastener secured to the flap to register with and engage a second part of the releasable fastener which is secured to the adjacent side. The first and second parts of the releasable fastener require a force for separation which is below a force required to tear the flap or the adjacent side.

The packaging system may further include a securing means for securing the contents from unfolding while permitting tactile contract with the contents to facilitate opening of the carton, removal and touching of the contents without unfolding the contents, replacement of the contents in the carton and closing of the carton without damage to the carton.

The packaging system may further include a messaging system having message storage means, message playing means and first and second user interfaces. The message storage means stores a message. The message playing means communicates with the message storing means for playing the message. The first user interface communicates with the message playing means for initiating the playing of the message. The second user interface communicates with the message playing means for presenting the message to the user.

The releasable fastening means may be magnetic fasteners, dome fasteners, hook loop fasteners, low tack adhesives, hook and eye fasteners and latches.

The first user interface may be a push button or a proximity sensor.

The second user interface may be a speaker or a video screen.

The carton may further include a window extending through a side thereof for permitting tactile contact with the contents without opening of the carton.

DESCRIPTION OF DRAWINGS

Preferred embodiments of the present invention are described below with reference to the accompanying illustrations in which.

DETAILED DESCRIPTION OF PREFERRED EMBODIMENTS

Figure 1:
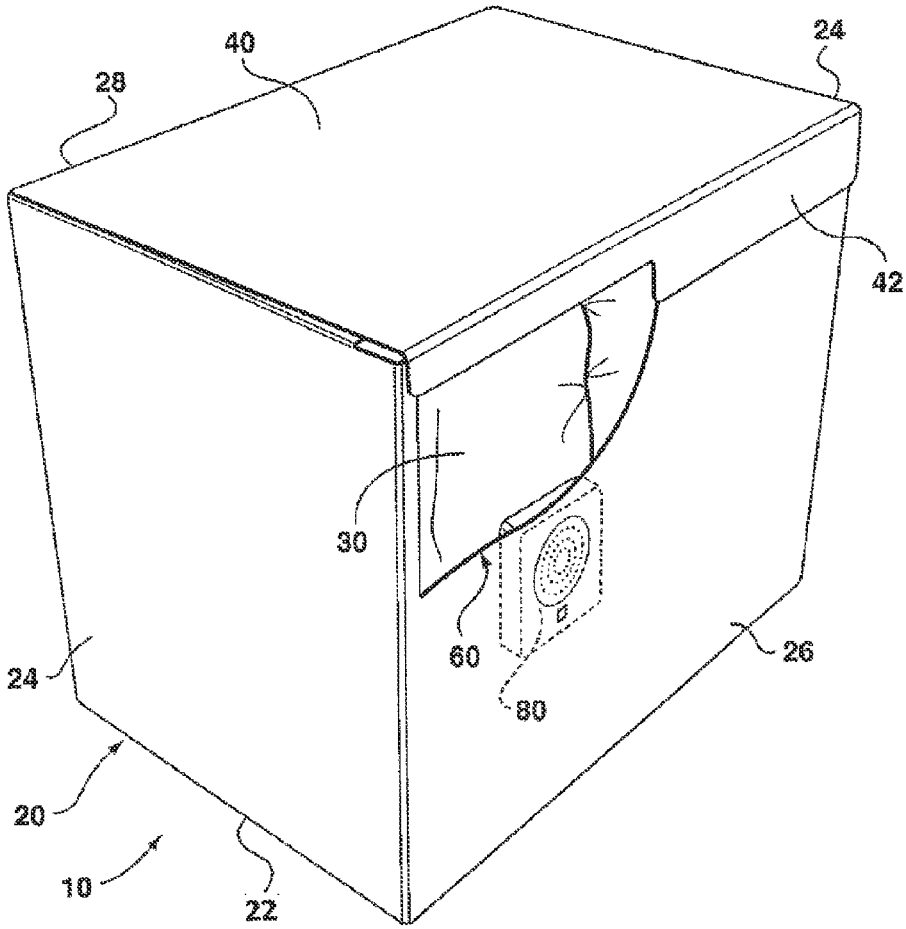
FIG. 1 is a perspective view of a carton according to the present invention.

A packaging system according to the present invention is generally indicated by reference 10 in the accompanying illustrations. The packaging system has a plurality of walls including a bottom wall 22 extending upwardly from which are front opposite end walls 24, front wall 26 and rear wall 28. The walls 22, 24 and 26 collectively define an enclosure for receiving product 30 such as the seat cover illustrated. Greater or fewer walls may be provided.

Figure 2:
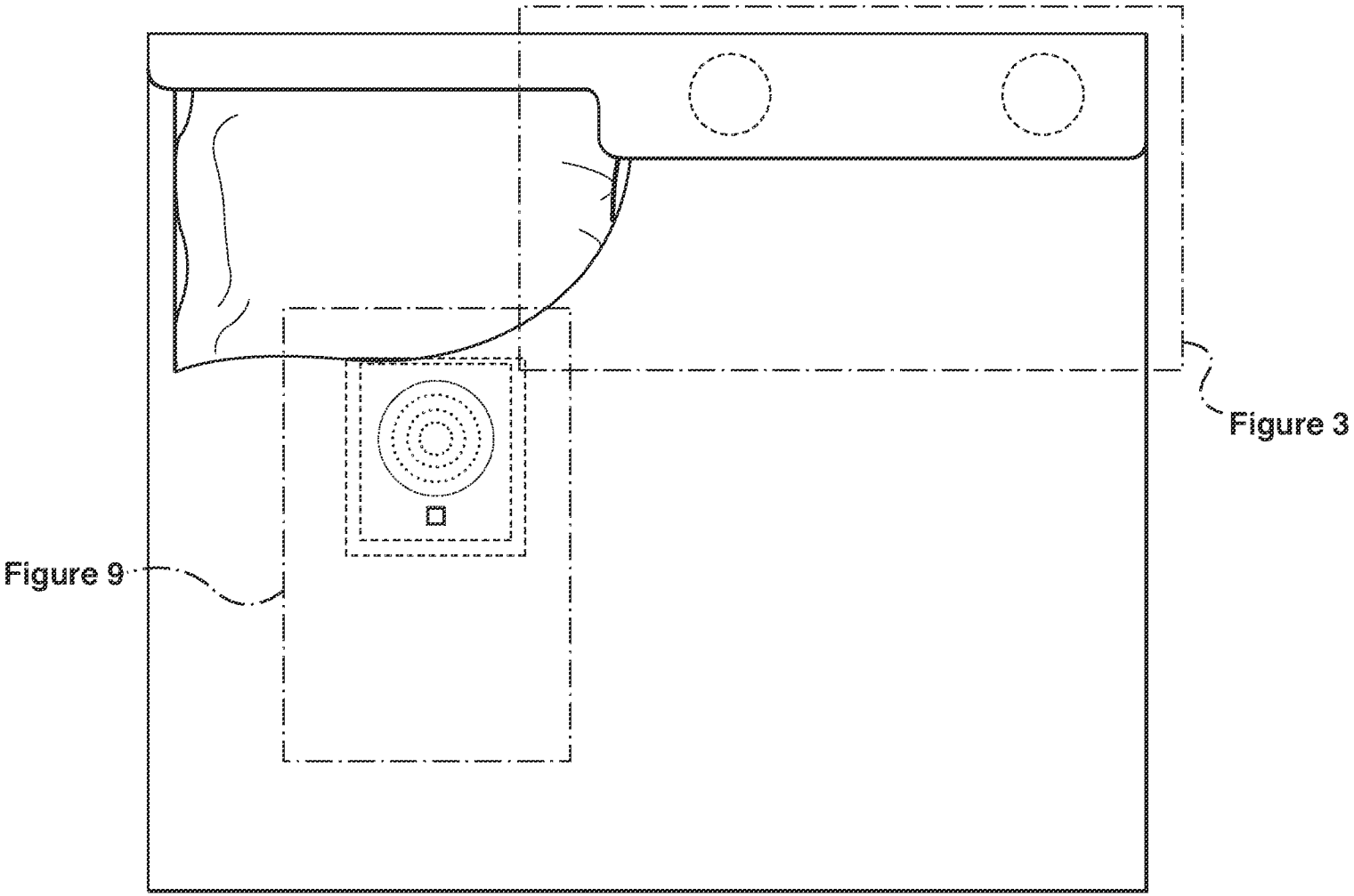
FIG. 2 is a front elevation corresponding to FIG. 1.
Figure 3:
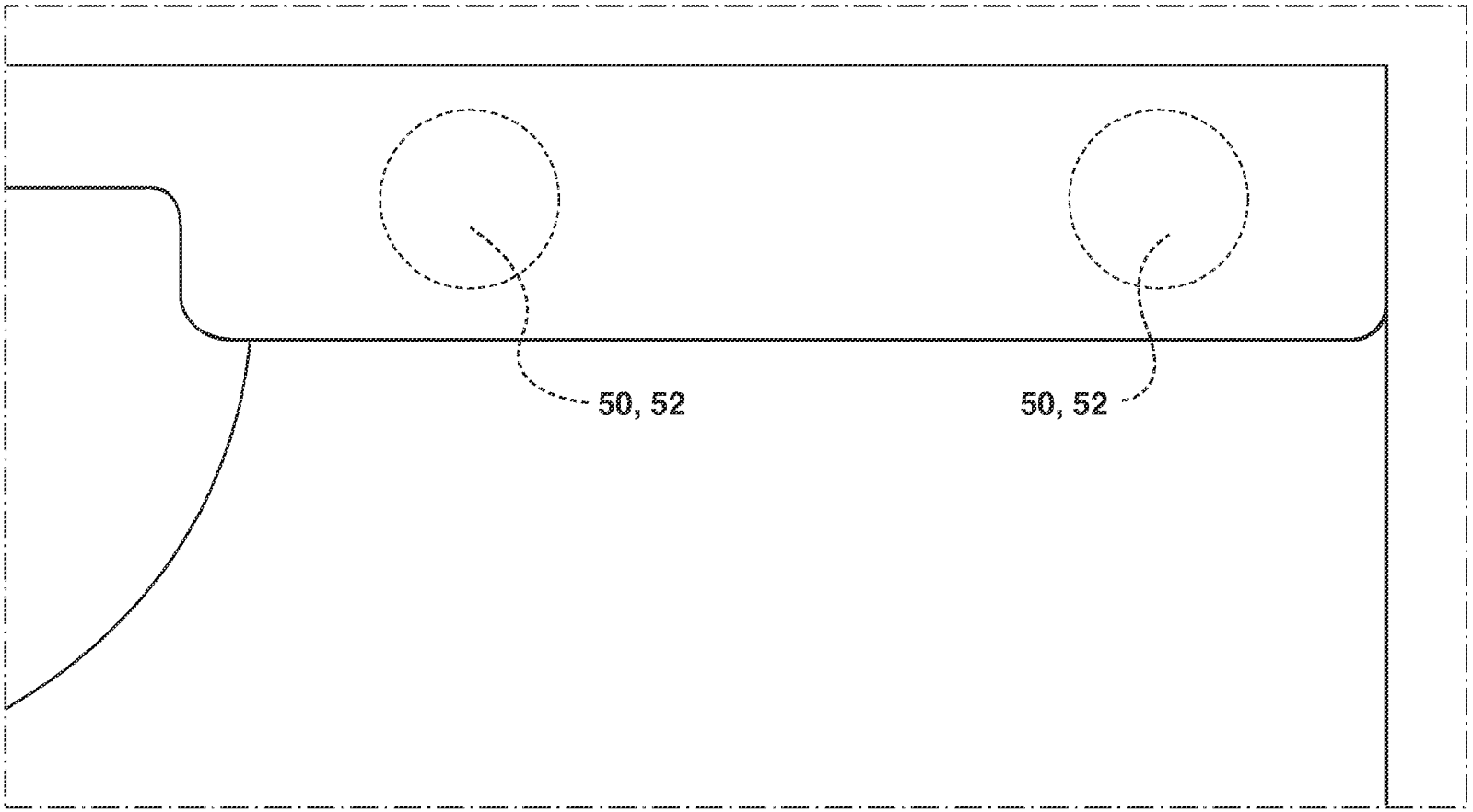
FIG. 3 shows an enlargement of the area within the box labelled 3 in FIG. 2.

A lid 40 hingedly attaches to the carton 20 along an upper edge of the rear wall 28. The lid is hingedly moveable between a closed configuration illustrated in FIGS. 1, 2 and 3, and an open configuration illustrated in FIGS. 4, 6, 7 and 8.

The lid has a front flap 42 which overlies the front wall 26 of the carton when the carton is in its closed configuration. The front flap may be releaseably secured to the balance of the carton 20 by any suitable releaseable securing means which enables release without tearing of the carton 20. Suitable means include magnetic fasteners such as magnets 50 secured to the front wall 26 of the carton 20 near the top of the front wall 20 which register with magnetic plates 52 secured to the flap 42 to releaseably hold the flap 42 against the front wall 26 by magnetic attraction.

Figure 4:
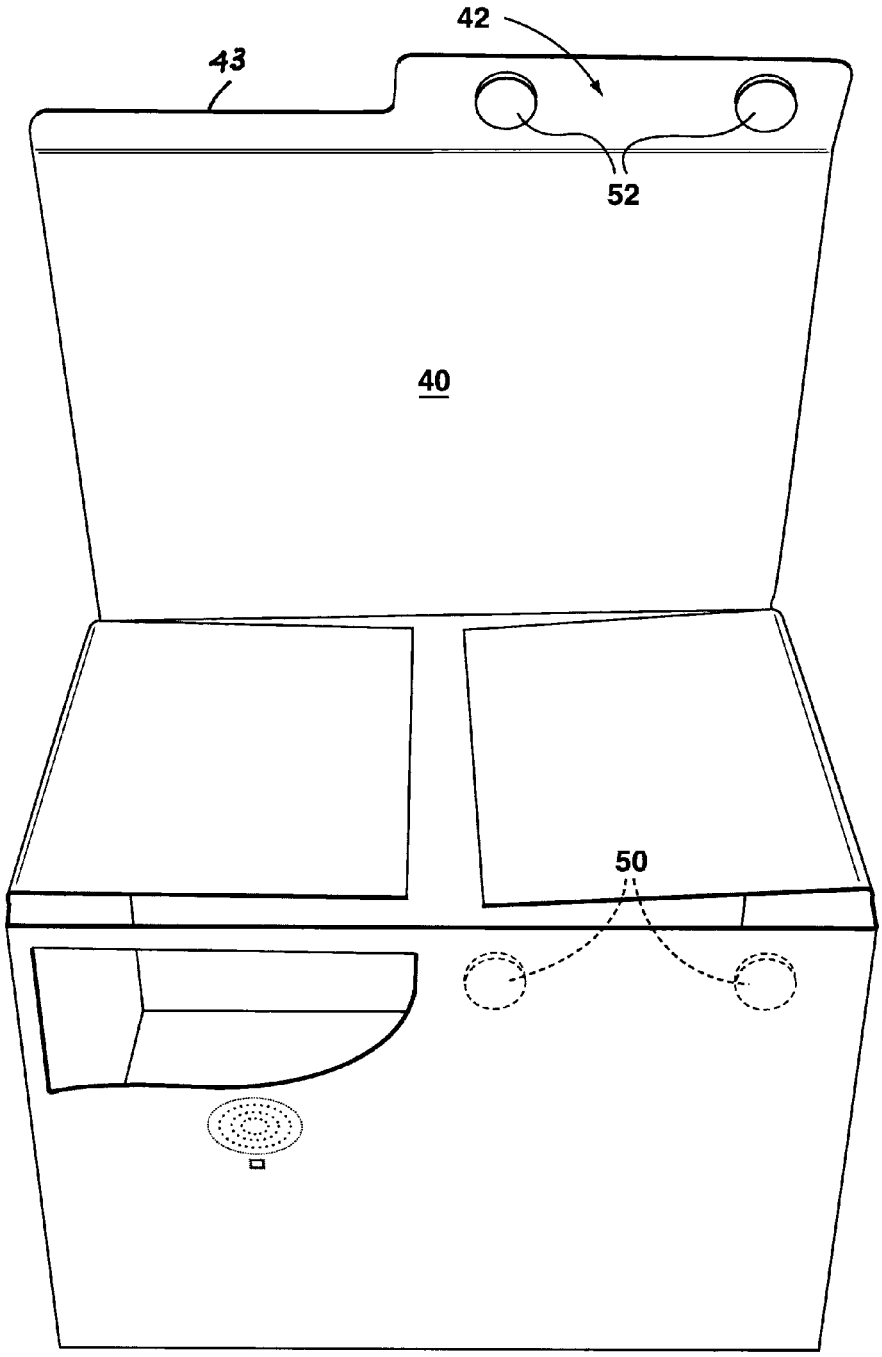
FIG. 4 is a perspective view from above and to the front illustrating a carton according to the present invention in an open configuration.
Figure 5:
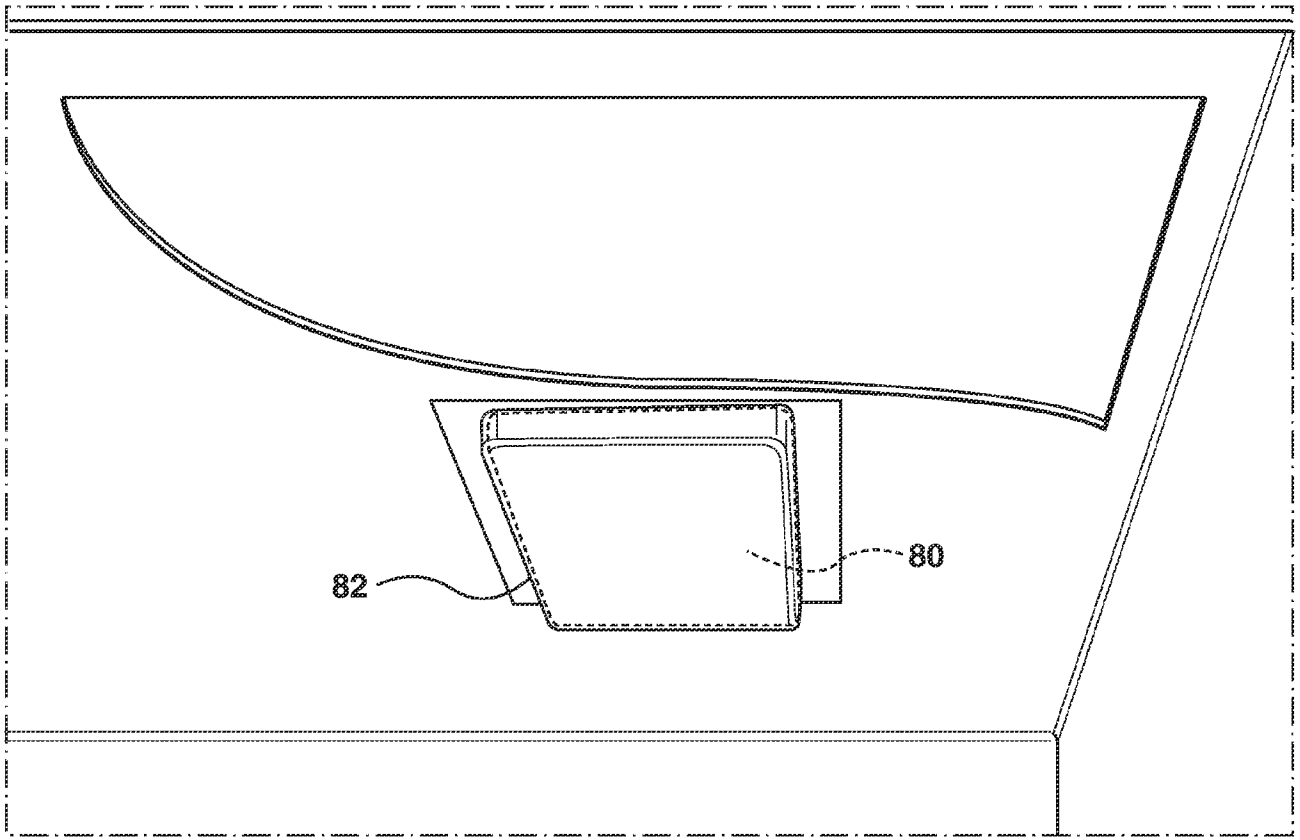
FIG. 5 is a perspective view of a portion of the inside front wall of a carton according to the present invention illustrating a talking module.

The front flap 42 as a cutout portion 43 adjacent window 60. As will be discussed, the window 60 provides for visual and tactile inspection of the contents. As best seen in FIG. 4, the magnetic plates 52 are secured to the flap 42 away from the cutout portion 43 of the flap 42.

Other releaseable securing means might be used for example mating parts of a hook and loop fastener system, a dome fastener system, low tack adhesive and a latch such as a hook and eye arrangement or other releasable latching means.

It will be appreciated that the presence of a non-damaging securing means facilitates the lifting of the flap and subsequent movement of the lid into the open configuration to permit access to the contents of the carton 20. The lid can subsequently be moved back to the closed configuration and the releaseable fastening means will, at least in the case of the magnet and metal plate arrangement, automatically close to a secure but not sealed configuration.

A window 60 may be provided through the front wall 26 of the carton 20 for both visual and tactile inspection of the contents. The window may be omitted or placed elsewhere on the carton 20.

Despite an easily openable and recloseable configuration, it may be necessary at least in some instances to provide securing means for the article to be inserted into the box to resist the article being unfolded or otherwise reshaped in such a manner as to appear untidy and raise question as to whether the contents of the package are complete. The illustrations show a seat cover as the product 30. Other products may be so packaged including, without limitation, linens, table cloths, car covers, etc. A seat cover set may include a plurality of seat covers and even those may have top and bottom parts. Once a seat cover set has been removed from the carton and opened, it may be difficult to stuff the entire seat cover back into the carton. Furthermore if someone were to open the carton and see a seat cover kit in disarray inside of the carton, they might wonder whether all of the pieces were there.

Figure 6:
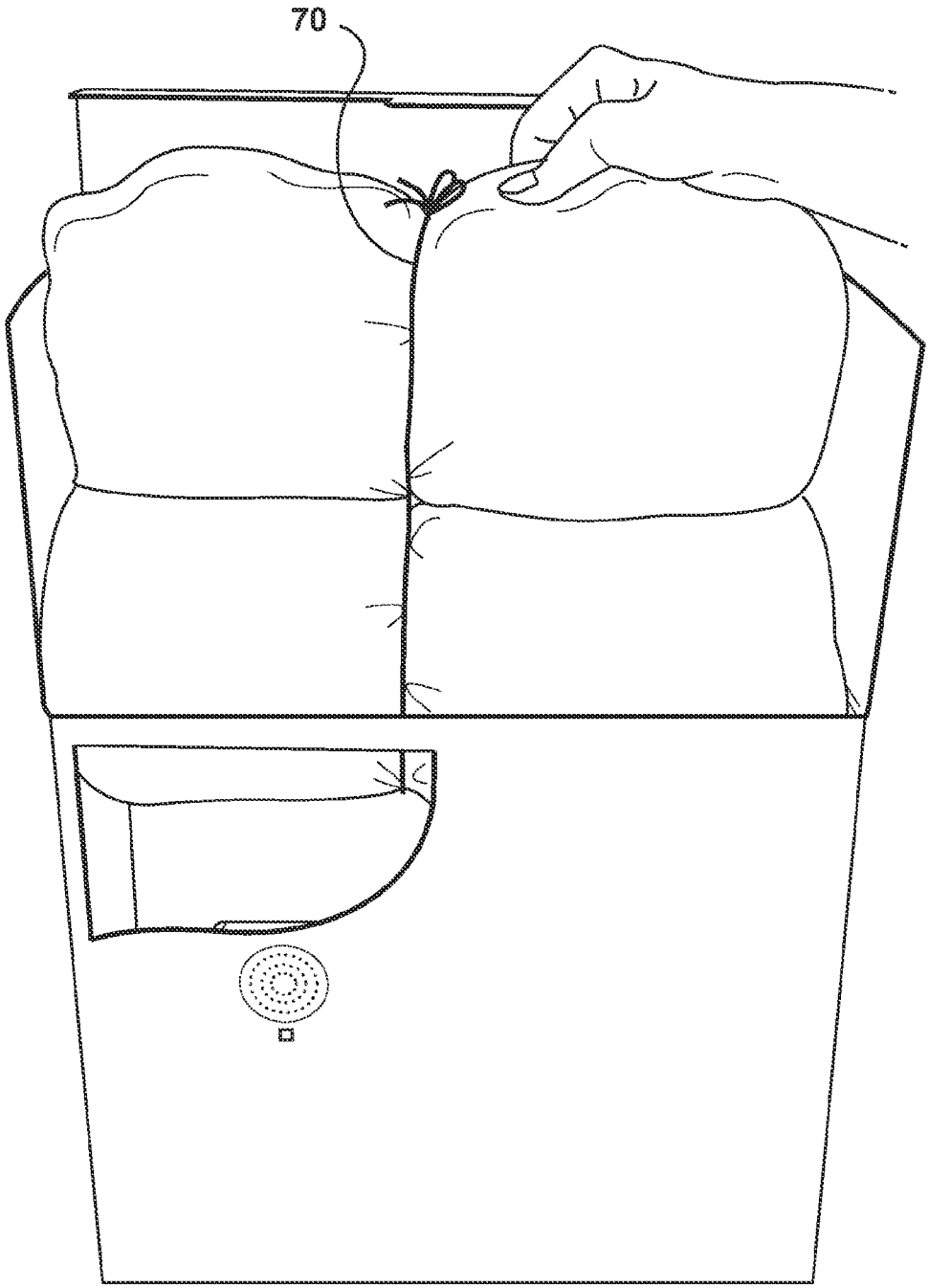
FIG. 6 is a perspective view from the front of a packaging system incorporating a carton according to the present invention and showing the securement of foldable items for placement into the carton.
Figure 7:
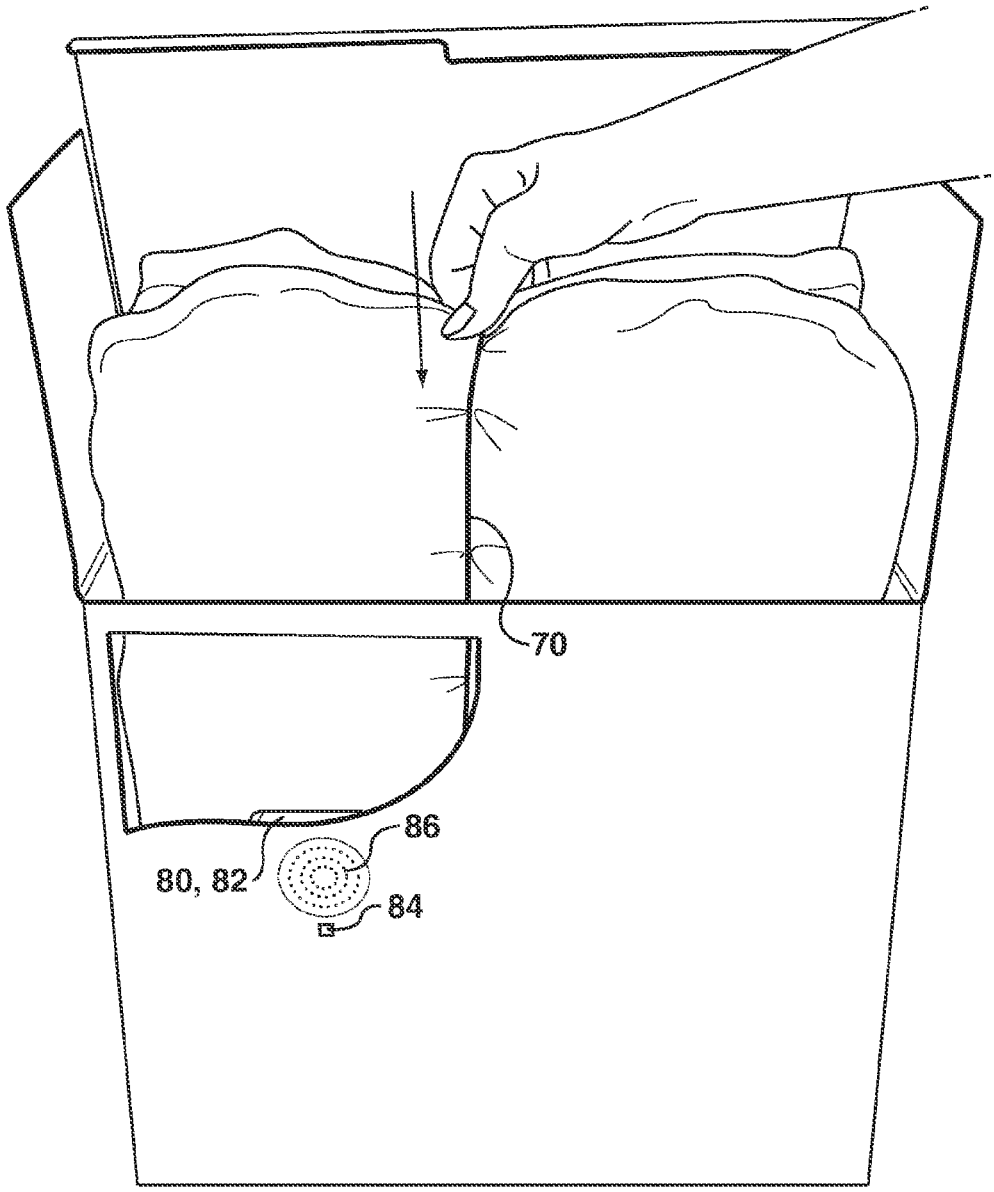
FIG. 7 is a view corresponding to FIG. 6 but showing the contents and further in the carton.
Figure 8:
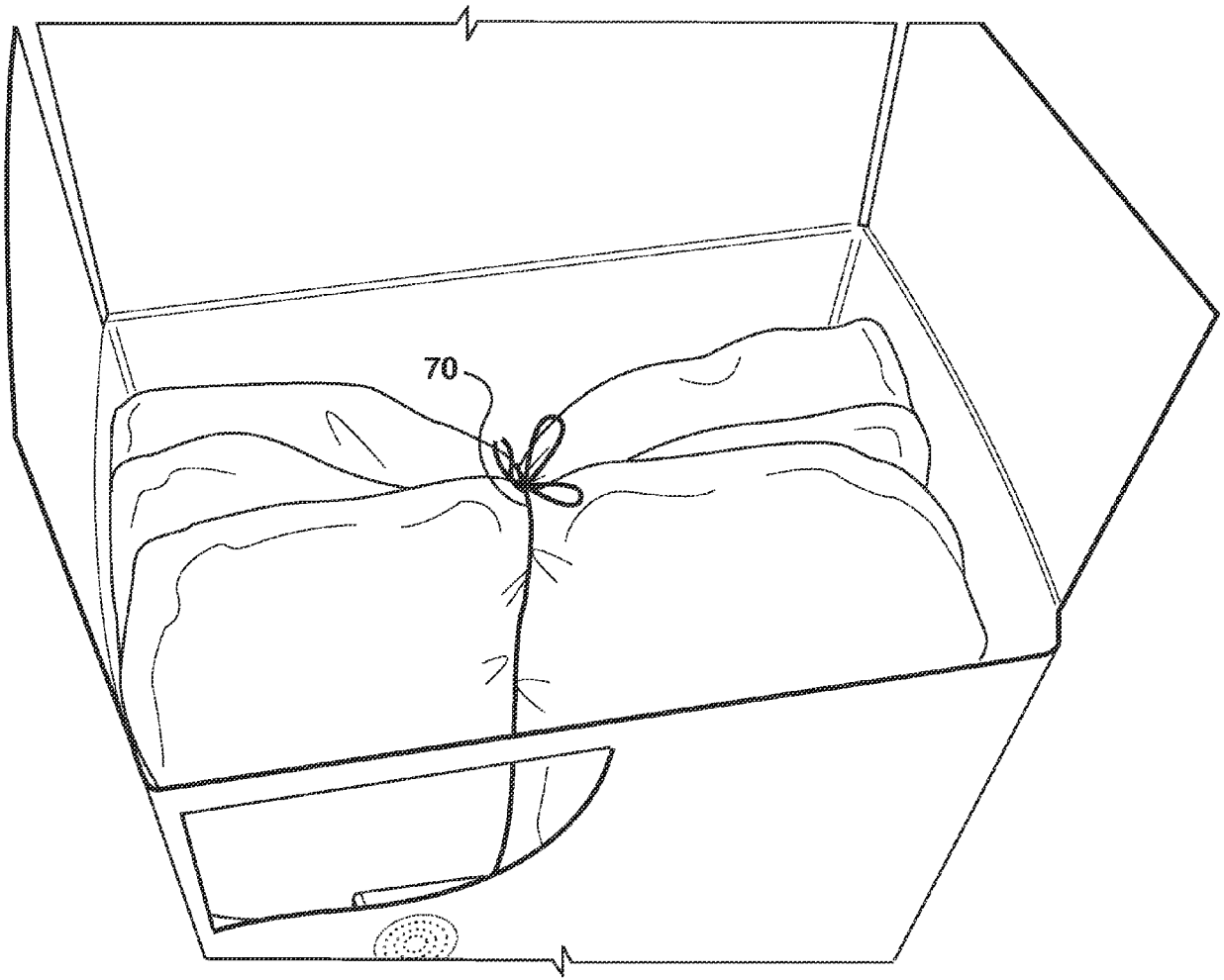
FIG. 8 is a perspective view corresponding to FIGS. 6 and 7 but showing the contents fully within the carton.
Figure 9:
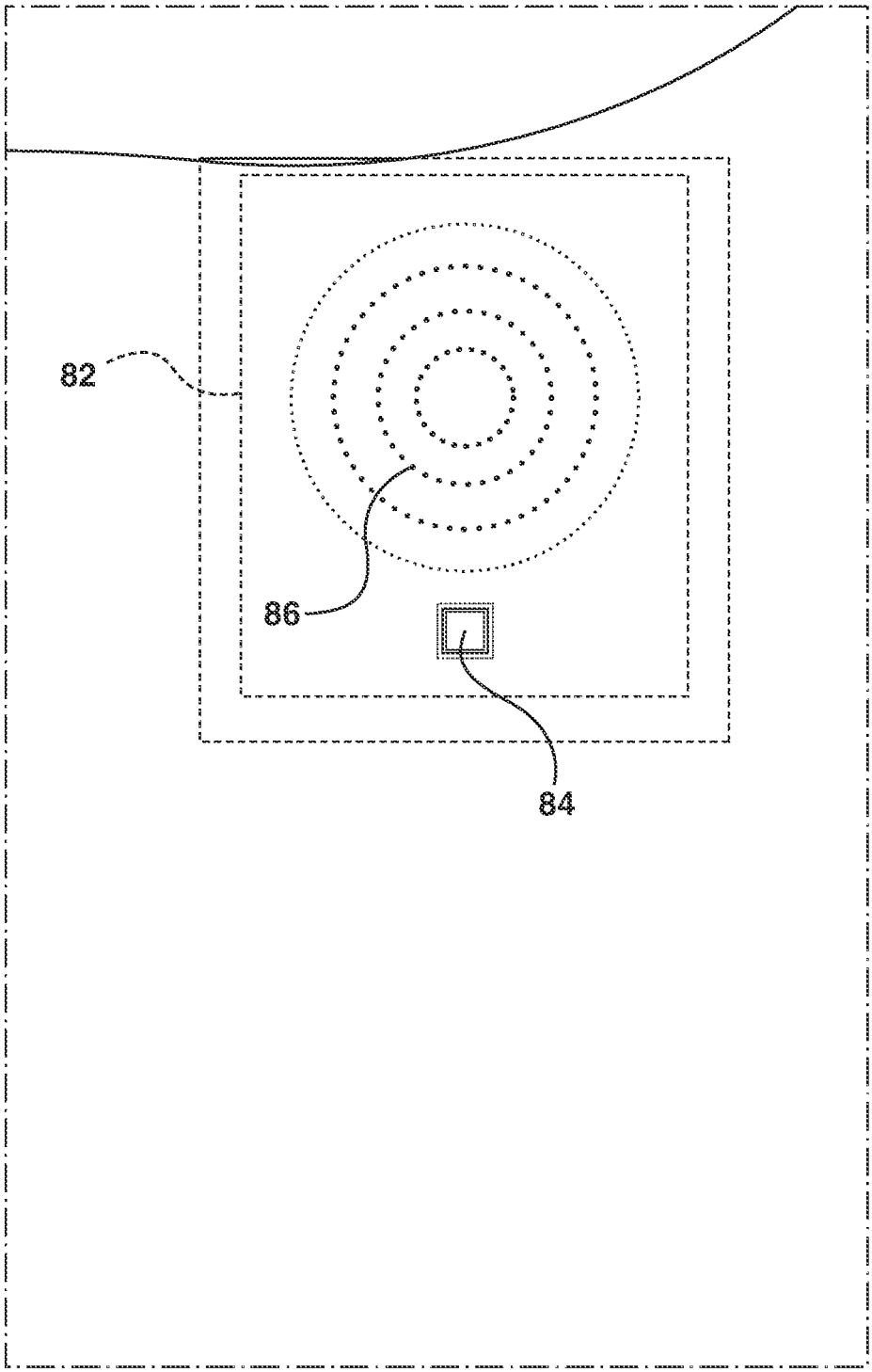
FIG. 9 is an enlargement of the area surrounded by box 9 in FIG. 2.

In accordance with the present invention, the contents of the carton are secured by securing means such as a jute string 70 illustrated in FIGS. 6, 7 and 8 or other cord, strap, etc. which can be cut by the end user to release the individual components but would not be removable by a consumer in a casual inspection of the contents as tools or excessive force would be required. The jute string prevents removal of the contents and touching of the contents without the contents unfolding or separating. Accordingly, the contents or product 30 may be removed, touched or otherwise inspected and easily replaced in the carton 20 and the carton 20 closed without the appearance of having been opened.

A further feature of the packing system 10 of the present invention is a talking module 80 having a housing 82 mounted for example to the inner face of the front wall 26 of the carton 20. The talking module has a storage means for a voice or visual recording. The storage means may be digital, magnetic tape or other suitable means as well known in the art.

The talking module further has a first user interface for initiating retrieval and play of the recording from the storage device. The first user interface may for example be a push button 84 as illustrated.

The talking module 80 has a second user interface for presenting the message to a user. The second user interface may for example be the speaker 86 illustrated. Alternatively the recording might be a non-voice recording in which case the second user interface 86 might for example be a display screen.

The above description is intended an illustrative rather than a restrictive sense. Variations may be apparent to persons skilled in the art without departing from the spirit and scope of the invention as defined by the claims set out below.

I claim:

1. A packaging system that enables a potential purchase of goods to touch and see the goods without damaging the packaging, said packaging system comprising:

a carton formed of a plurality of folded walls of sheet stock, said carton containing automotive soft goods selected from the group of seat covers and car covers;

one of the walls being a front wall and another of the walls being a top;

an edge of the top being folded adjacent the front wall to form a flap extending substantially the entire width of the top, one side edge of the flap having a cut-out portion;

a first part of a magnetic fastener on an inner surface of the flap;

a second part of a magnetic fastener on at outer surface of the front wall, said first and second parts mating with each other to secure the flap to the front wall of the carton to close the top; the first and second parts being releasable with a force below a force required to tear said flap; and a window in a wall to permit a potential user to touch and see the goods through the window, the window being located in the front wall adjacent the cut-out portion of the flap.

2. A packaging system as claimed in claim 1 further comprising a securing means for securing said contents from unfolding while permitting tactile contact with said contents to facilitate opening of said carton, removal and touching of said contents without unfolding said contents, replacement of said contents in said carton and closing of said carton without damage to said carton.

3. The packaging system of claim 1 further comprising a messaging system having:

message storage means;

message playing means communicating with said message storage means for playing said message;

a first user interface communicating with said message playing means for initiating said playing of said message;

a second user interface for communicating with said message playing means for presenting said message to said user.

4. The packaging system of claim 3 wherein said first user interface is a member selected from the group consisting of push button, a proximity sensor; and, said second user interface is a speaker or a video screen.

5. The packaging system of claim 1 wherein the first and second parts of the magnetic fasteners are located away from the cut-out portion of the flap.

* * * * *